US008374524B2

(12) United States Patent
Holmes et al.

(10) Patent No.: US 8,374,524 B2
(45) Date of Patent: Feb. 12, 2013

(54) RETAINING CLIP FOR PRINTER CARTRIDGE

(75) Inventors: Denny Holmes, Los Angeles, CA (US); Craig S. Rummler, Marina Del Rey, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 276 days.

(21) Appl. No.: 12/806,665

(22) Filed: Aug. 17, 2010

(65) Prior Publication Data

US 2011/0044720 A1 Feb. 24, 2011

Related U.S. Application Data

(60) Provisional application No. 61/274,616, filed on Aug. 18, 2009.

(51) Int. Cl.
*G03G 15/08* (2006.01)

(52) U.S. Cl. ..... 399/109; 399/113

(58) Field of Classification Search ..... 399/105, 399/109, 107, 113, 119, 120, 262
See application file for complete search history.

(56) References Cited

U.S. PATENT DOCUMENTS 6,240,605 B1 * 6/2001 Stevens et al. ..... 24/546

* cited by examiner

*Primary Examiner* — Walter L Lindsay, Jr.
*Assistant Examiner* — Barnabas Fekete

(57) ABSTRACT

There is provided a retaining clip apparatus and method for securing a toner feeder gear housing to a toner hopper of a toner printer cartridge. The apparatus comprises a first end configured to engage a protruding edge of the toner hopper. The apparatus further comprises a second end having a first surface configured to engage a portion of the toner feeder gear housing and having a second surface configured to engage a portion of the top cover housing, such that the second end is positioned within a space between the top cover housing and the toner feeder gear housing. The apparatus further comprises an elongated body portion connecting the first end to the second end.

20 Claims, 13 Drawing Sheets

RETAINING CLIP FOR PRINTER CARTRIDGE

CROSS REFERENCE TO RELATED APPLICATION

This application claims the benefit of U.S. Provisional Patent Application Ser. No. 61/274,616, filed Aug. 18, 2009, which is incorporated herein by reference in its entirety.

STATEMENT RE: FEDERALLY SPONSORED RESEARCH/DEVELOPMENT (Not Applicable)

FIELD

The disclosure relates to electrophotography, particularly an apparatus and methods for remanufacturing toner printer cartridges.

BACKGROUND

Used printer cartridges of fax machines, copiers, inkjet printers, and laser printers are often remanufactured. The process of remanufacturing a printer cartridge may include cleaning the cartridge, repairing damaged parts, replacing worn parts, or replenishing the cartridge with toner. The process of remanufacturing a toner printer cartridge requires that the toner cartridge be disassembled so that access to the various parts can be achieved, and further requires that the toner printer cartridge be reassembled for subsequent use.

Toner printer cartridges typically have two main parts—the toner hopper and the waste hopper. The toner is typically stored in the toner hopper. Toner is usually added into the printer cartridge by pouring toner into a toner hopper, which defines a toner opening port. During or after remanufacturing, the toner opening port usually has to be sealed so that toner will not leak during shipment and anytime prior to the use of the cartridge.

Existing toner opening port sealing methods include the use of split seals and insertion seals. The use of split seals requires splitting printer cartridge portions, such as a magnetic roller section and the toner hopper, so that the toner opening port can be accessed to install the split seal. The use of a split seal often involves more resources than the use of insertion seals, as time and labor need to be spent on splitting the cartridge and reassembling the split cartridge.

Insertion seals typically do not require splitting of the printer cartridge and are typically installed in the printer cartridge by insertion through toner exit ports. Toner exit ports are openings that are adjacent to the toner opening ports and that lead to the toner opening ports. In some toner printer cartridges, toner exit port plugs are used to cover and prevent toner leakage around the toner exit ports. At least one problem with the use of existing insertion seals is that when they are detached from the printer cartridge just before use, insertion seals can pull along with them the toner exit port plugs. The toner exit port plugs get displaced, and toner is allowed to leak. In addition, when existing insertion seals are inserted into the toner hopper, such existing insertion seals can damage foam sealing portions (see reference number 40 of FIG. 7C) that are designed to prevent toner leaks from the toner hopper. If the foam sealing portions are damaged, toner can leak from the toner hopper.

In addition, existing toner hopper seals can make subsequent cycles of remanufacturing of toner printer cartridges difficult in that such seals can decrease the ease of separating the toner printer cartridge in the next remanufacturing cycle.

In addition, original equipment manufacturers (OEMs) typically orient and align the parts of an OEM toner printer cartridge together by ultrasonic or plastic welding. For example, toner cartridge parts that may be welded together by ultrasonic or plastic welding may include the toner hopper and the waste hopper, the end caps and the toner hopper such as the contact end cap and the toner hopper, and the end plates and the waste hopper. Such parts may also be held together with one or more fasteners, such as screws, or another type of fastener. During the remanufacturing disassembly process, the welded parts are typically detached from each other by breaking or cutting the ultrasonic or plastic welds and/or the fasteners. The breaking or cutting process may involve using conventional tools, such as blades, screw drivers, and rotary tools, in combination with force to break or cut the ultrasonic or plastic welds and/or the fasteners. As a result of such breaking or cutting, the original weld and fastener locations may not have sufficient material left to be secured with new fasteners. For example, after disassembly, threaded holes or openings may have stripped or worn threads that do not allow a fastener, such as a threaded screw, to adequately secure the disassembled toner cartridge parts back together.

In the process of remanufacturing, known devices and methods exist for securing back together disassembled toner printer cartridge parts such as toner hoppers and parts that attach to toner hoppers. Such known devices and methods include using adhesives or glues to secure the disassembled toner cartridge parts back together. However, such known adhesives or glues can increase the time for remanufacturing the toner printer cartridge, as there is typically a waiting period of minutes or hours required for sufficient bonding of the toner cartridge parts with the adhesive or glue. Moreover, keeping the toner printer cartridge parts properly aligned while waiting for the adhesive or glue to bond can be challenging and can increase the overall time for remanufacturing. In addition, such adhesives or glues can bond the toner printer cartridge parts so strongly together that subsequent disassembly and separation for additional cycles of remanufacturing can be difficult, resulting in decreased efficiency in the remanufacturing process or possible damage to the toner cartridge.

Other known devices and methods of securing disassembled toner printer cartridge parts back together include performing ultrasonic or plastic welding at the original weld location or at another location on the toner cartridge. However, such ultrasonic and plastic welding can be complex processes requiring expensive equipment and machinery and can increase the overall cost of remanufacturing. Moreover, such ultrasonic and plastic welding can join the toner printer cartridge parts so strongly together that subsequent disassembly and separation for additional cycles of remanufacturing can be difficult, resulting in decreased efficiency in the remanufacturing process or possible damage to the toner printer cartridge.

Accordingly, there is a need for an apparatus and method for remanufactured toner printer cartridges that overcomes the issues associated with known apparatuses and methods.

SUMMARY

This need for an apparatus and method for remanufactured toner printer cartridges is satisfied. The disclosure provides for a retaining clip apparatus and method for a toner hopper for toner printer cartridges, preferably remanufactured toner printer cartridges, that eliminates or minimizes toner leaks, that securely retains a toner feeder gear housing to a toner hopper, that helps preserve the appearance of remanufactured toner printer cartridges, that minimizes remanufacturing steps, that extends the life of the remanufactured toner printer cartridge, and that allows a toner printer cartridge remanufacturer to easily separate the toner hopper from the toner feeder gear housing during the next remanufacturing cycle. There is provided a retaining clip apparatus and method for securing a toner feeder gear housing to a toner hopper of a toner printer cartridge.

In one embodiment there is provided a retaining clip apparatus for securing a toner hopper of a toner printer cartridge. The toner hopper has a toner feeder gear housing and a top cover housing. The apparatus comprises a first end configured to engage a protruding edge of the toner hopper. The apparatus further comprises a second end having a first surface configured to engage a portion of the toner feeder gear housing and having a second surface configured to engage a portion of the top cover housing. The second end is positioned within a space between the top cover housing and the toner feeder gear housing, wherein when the top cover housing is attached to the toner hopper, the top cover housing presses against the second end, and the second end applies a downward force against the portion of the toner feeder gear housing. The apparatus further comprises an elongated body portion connecting the first end to the second end, the elongated body portion having one or more abutting surfaces configured to abut one or more portions of the toner feeder gear housing. The retaining clip apparatus secures the toner feeder gear housing to the toner hopper.

In another embodiment there is a provided a remanufactured toner printer cartridge comprising a toner hopper, a toner feeder gear housing, a top cover housing, a seal, and one or more retaining clip apparatuses for securing the toner feeder gear housing to the toner hopper. The retaining clip apparatus comprises a first end configured to engage a protruding edge of the toner hopper. The retaining clip apparatus further comprises a second end a second end having a first surface configured to engage a portion of the toner feeder gear housing and having a second surface configured to engage a portion of the top cover housing, such that the second end is positioned within a space between the top cover housing and the toner feeder gear housing. When the top cover housing is attached to the toner hopper, the top cover housing presses against the second end, and the second end applies a downward force against the portion of the toner feeder gear housing. The retaining clip apparatus further comprises an elongated body portion connecting the first end to the second end, the elongated body portion having one or more abutting surfaces configured to abut one or more portions of the toner feeder gear housing. The retaining clip apparatus secures the toner feeder gear housing to the toner hopper.

In another embodiment there is provided a method for remanufacturing a toner printer cartridge. The method comprises providing a toner printer cartridge having a toner hopper with a depleted supply of toner, a toner feeder gear housing, and a top cover housing. The method further comprises separating the toner feeder gear housing and the top cover housing from the toner hopper. The method further comprises disassembling the toner hopper. The method further comprises cleaning the toner hopper. The method further comprises refilling the toner hopper with a supply of toner. The method further comprises reassembling the toner hopper that has been refilled. The method further comprises attaching a seal between a portion of the toner hopper that has been refilled and a portion of the toner feeder gear housing. The method further comprises attaching the toner feeder gear housing to the toner hopper that has been refilled. The method further comprises securing the toner feeder gear housing to the toner hopper that has been filled with one or more retaining clip apparatuses. The retaining clip apparatus comprises a first end configured to engage a protruding edge of the toner hopper. The retaining clip apparatus further comprises a second end having a first surface configured to engage a portion of the toner feeder gear housing and having a second surface configured to engage a portion of the top cover housing, such that the second end is positioned within a space between the top cover housing and the toner feeder gear housing. The retaining clip apparatus further comprises an elongated body portion connecting the first end to the second end, the elongated body portion having one or more abutting surfaces configured to abut one or more portions of the toner feeder gear housing. The method further comprises attaching the top cover housing to the toner hopper that has been refilled to form a remanufactured toner printer cartridge.

In another embodiment of the disclosure there is provided a retaining clip apparatus for securing a toner hopper portion of a toner printer cartridge. The apparatus comprises a first end that retains a protruding edge of the toner hopper, a second end having a first surface that engages a portion of a toner feeder gear housing and having a second surface that engages a portion of a top cover housing. The second end applies a downward force against the portion of the toner feeder gear housing when the top cover housing is attached to the toner hopper and is pressed against the second end. Preferably, the apparatus is unitary in shape and is comprised of a material selected from the group consisting of spring steel, aluminum, and resilient plastic.

In another embodiment of the disclosure there is provided a remanufactured toner printer cartridge comprising a toner hopper, a toner feeder gear housing, a top cover housing, a seal, and one or more retaining clips for securing the toner feeder gear housing to the toner hopper. The retaining clip comprises a first end that retains a protruding edge of the toner hopper and a second end having a first surface that engages a portion of the toner feeder gear housing and having a second surface that engages a portion of the top cover housing. The second end applies a downward force against the portion of the toner feeder gear housing when the top cover housing is attached to the toner hopper and is pressed against the second end. Preferably, the apparatus is unitary in shape and is comprised of a material selected from the group consisting of spring steel, aluminum, and resilient plastic.

The above description sets forth, rather broadly, a summary of embodiments of the disclosure so that the detailed description that follows may be better understood and contributions of the disclosure to the art may be better appreciated. Some of the embodiments of the disclosure may not include all of the features or characteristics listed in the above summary. There may be, of course, other features of the disclosure that will be described below and may form the subject matter of claims. In this respect, before explaining at least one embodiment of the disclosure in detail, it is to be understood that the disclosure is not limited in its application to the details of the construction and to the arrangement of the components set forth in the following description or as illustrated in the drawings. The disclosure is capable of other embodiments and of being practiced and carried out in various ways. The features, functions, and advantages that have been discussed can be achieved independently in various embodiments of the disclosure or may be combined in yet other embodiments further details of which can be seen with reference to the following description and drawings.

BRIEF DESCRIPTION OF THE DRAWINGS

The disclosure can be better understood with reference to the following detailed description taken in conjunction with the accompanying drawings which illustrate preferred and exemplary embodiments, but which are not necessarily drawn to scale, wherein.

DETAILED DESCRIPTION

Figure 1:
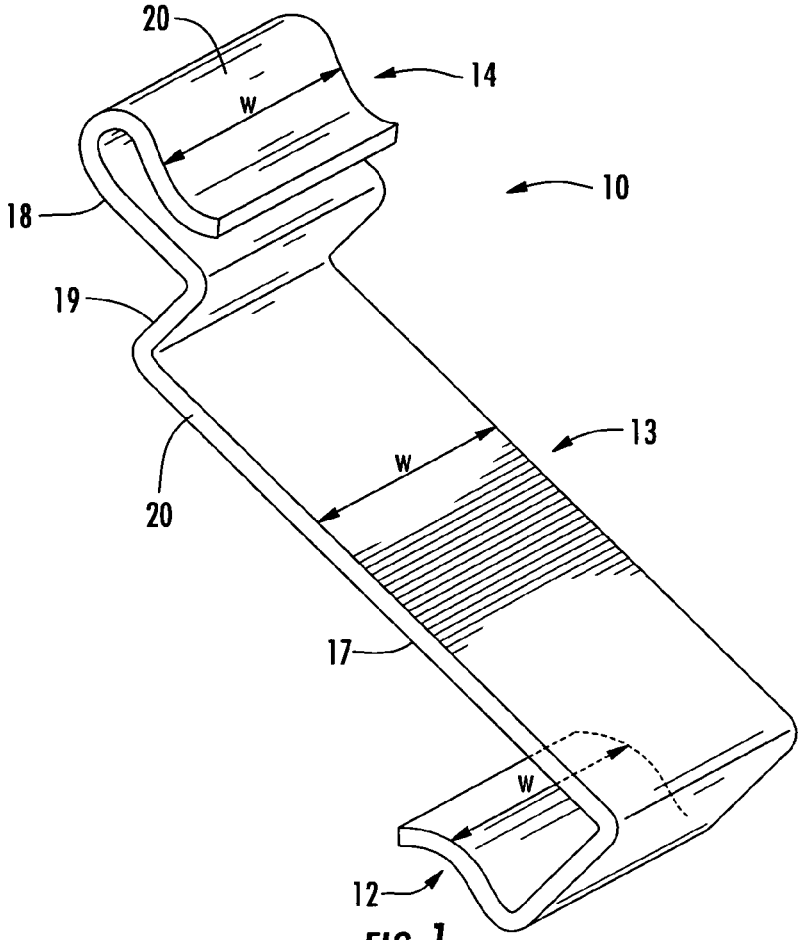
FIG. 1 is an illustration of a front perspective view of one of the embodiments of the retaining clip apparatus according to the disclosure.

Disclosed embodiments will now be described more fully herein after with reference to the accompanying drawings, in which some, but not all disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the disclosure. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the disclosure.

The disclosure provides various embodiments for a retaining clip apparatus 10 (FIG. 1) or 100 (FIG. 3) for use with an existing toner printer cartridge 26 (see FIG. 14), such as an HP (Hewlett-Packard) 6015 cartridge from Hewlett-Packard Company, or another suitable toner printer cartridge. Preferably, the toner printer cartridge 26 is a remanufactured toner printer cartridge 90 (see FIGS. 2 and 8-13). The retaining clip apparatus 10 or 100 engages a toner feeder gear housing 32 (see FIGS. 2 and 7C) and a top cover housing 36 (see FIGS. 2 and 7A) of a toner hopper (see FIGS. 2 and 8) and is used to secure the toner feeder gear housing 32 (see FIGS. 2 and 7C) to the toner hopper (see FIGS. 2 and 8).

FIG. 1 is an illustration of a front perspective view of one of the embodiments of the retaining clip apparatus 10 according to the disclosure. As shown in FIG. 1, the retaining clip apparatus 10 comprises a first end 12, a second end 14, and an elongated body portion 13 disposed between the first end 12 and the second end 14 and connecting the first end 12 and the second end 14. The elongated body portion 13 may comprise a substantially straight portion 17 and an angled portion 19 that angles upwardly at an angle 21, preferably a substantially 90 degree angle or another suitable angle size, from the substantially straight portion 17 toward the second end 14. The elongated body portion 13 preferably has one or more abutting surfaces 15*a*, 15*b* configured to abut one or more portions 23*a*, 23*b* of the toner feeder gear housing 32.

Figure 2:
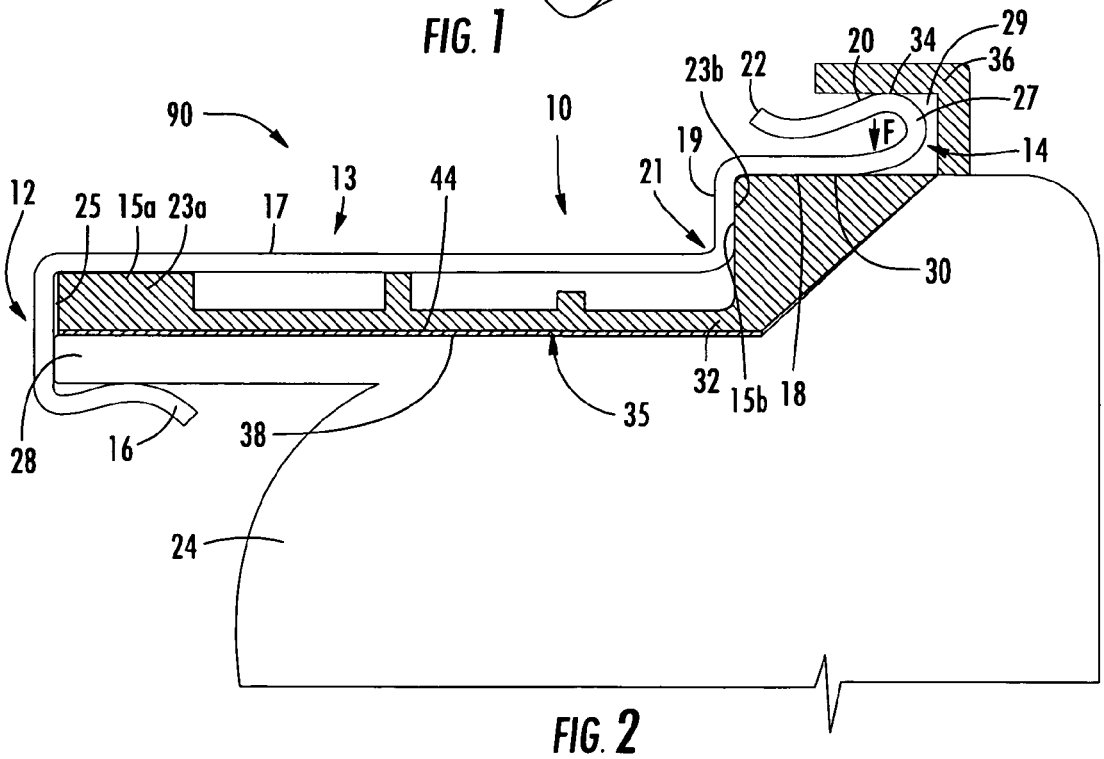
FIG. 2 is an illustration of a side view of the one of the embodiments of the retaining clip apparatus according to the disclosure in use with a remanufactured toner printer cartridge.
Figure 13:
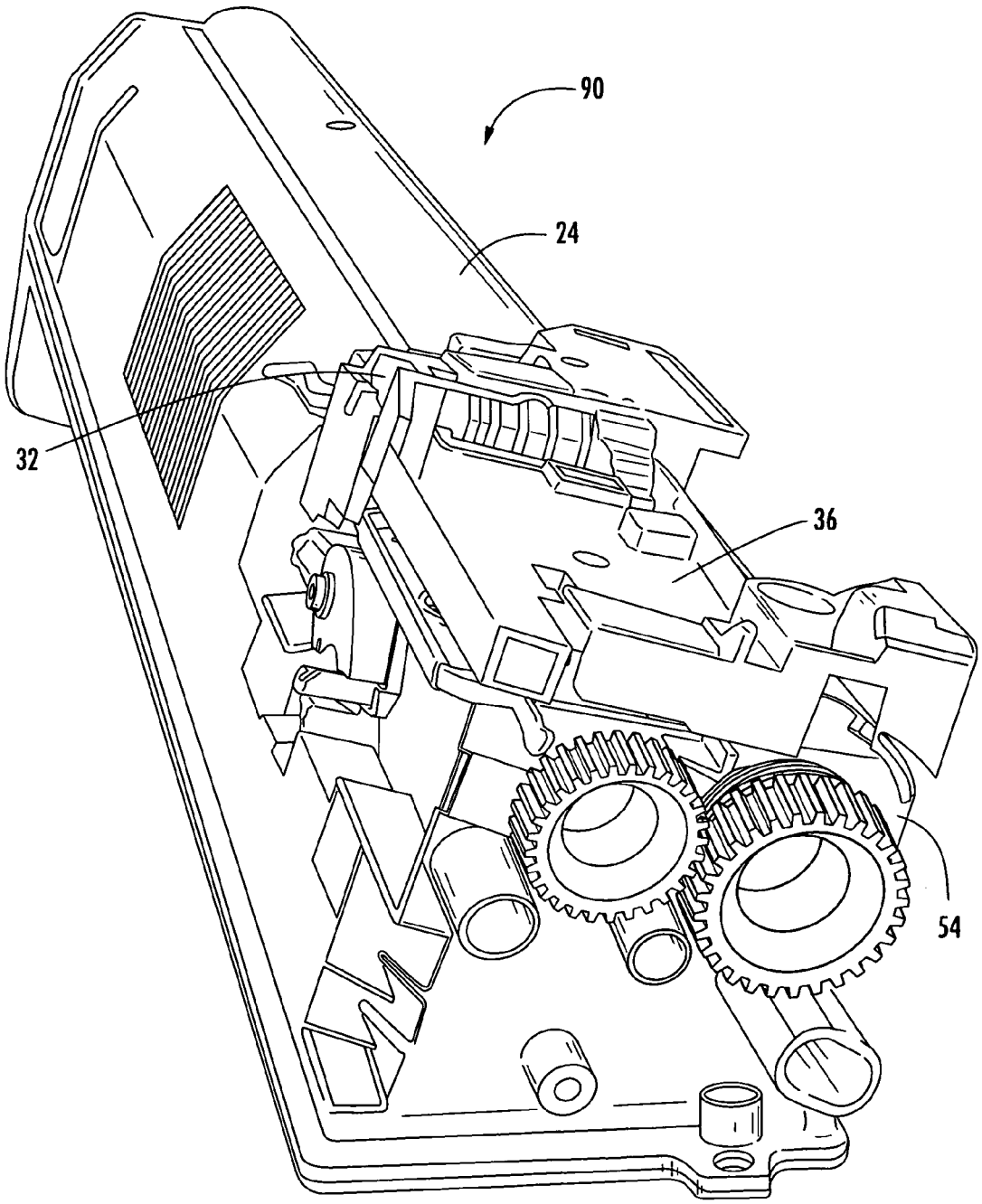
FIG. 13 is an illustration of a front perspective view of the remanufactured toner printer cartridge of FIG. 8 with the top cover housing attached over the toner feeder gear housing.
Figure 14:
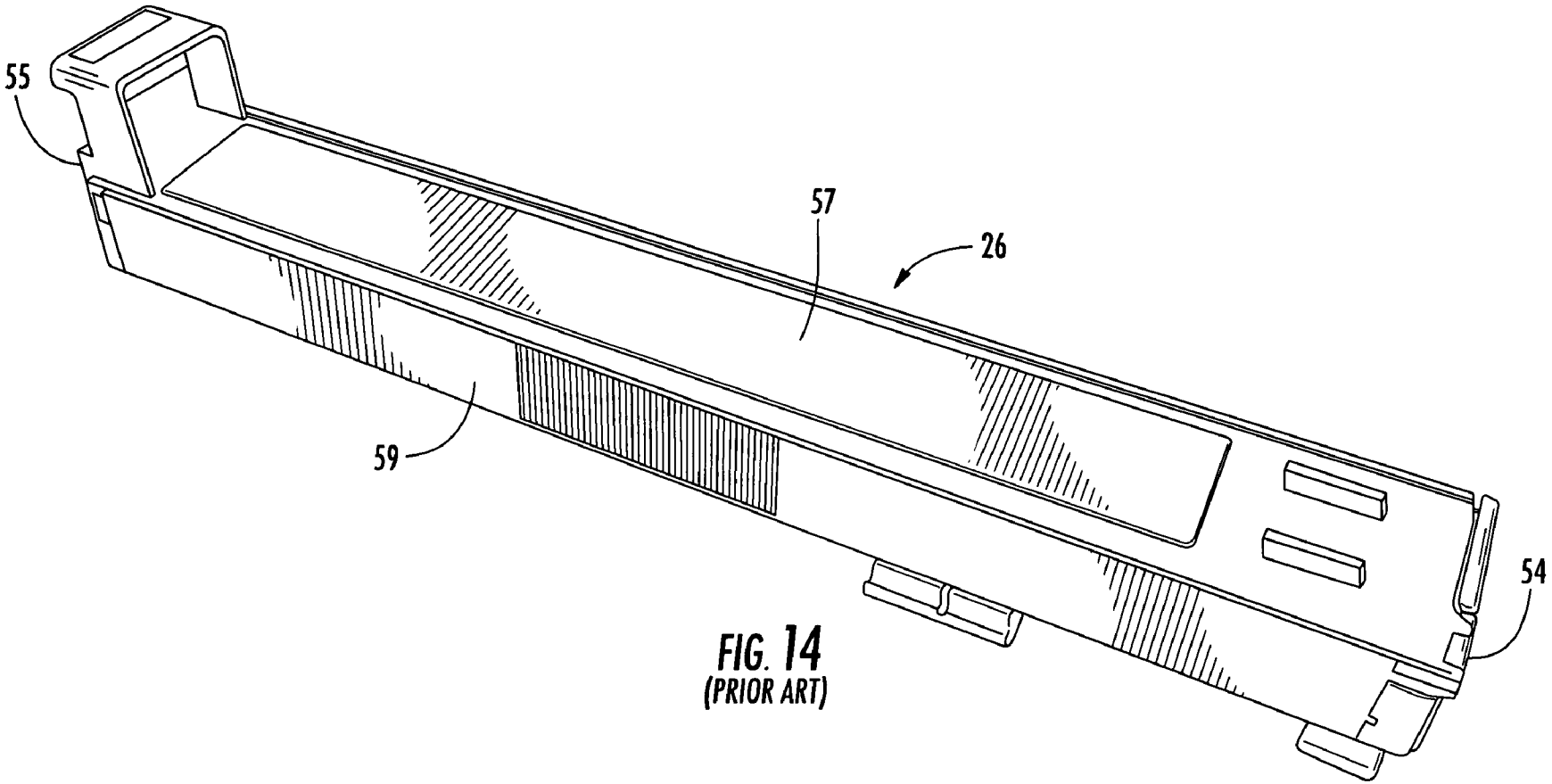
FIG. 14 (PRIOR ART)
FIG. 14 is an illustration of an existing toner printer cartridge that can be remanufactured using one of the embodiments of the retaining clip apparatus of the disclosure; and, FIG. 15 is an illustration of a flow diagram showing the steps of one of the embodiments of a method for remanufacturing a toner printer cartridge using one of the embodiments of the retaining clip apparatus of the disclosure.

FIG. 2 is an illustration of a side view of the retaining clip apparatus 10 according to the disclosure in use with toner hopper 24 of a remanufactured toner printer cartridge 90 (see also FIGS. 8-13) that has been remanufactured from existing toner printer cartridge 26 (see FIG. 14). As shown in FIG. 2, the first end 12 comprises a substantially U-shaped portion 25 and has a curved end piece 16. The first end 12 is designed and configured to engage and retain a protruding edge 28 of the toner hopper 24. The second end 14 has a first surface 18 and a second surface 20. The second end 14 comprises a substantially U-shaped portion 27 and has a curved end piece 22. The first surface 18 of the second end 14 is designed and configured to engage a portion 30 of the toner feeder gear housing 32. The second surface 20 of the second end 14 is designed and configured to engage a portion 34 of the top cover housing 36, such that the second end 14 is engaged and substantially positioned and fitted within a space 29 between the top cover housing 36 and the toner feeder gear housing 32. When the top cover housing 36 is attached to the toner hopper 24, the top cover housing 36 presses against the second end 14, and the second end 14 applies a downward force (F↓) (see FIG. 2) against the portion 30 of the toner feeder gear housing 32, thus further securing the retaining clip apparatus 10 in place. The retaining clip apparatus 10 is designed to secure and retain the toner feeder gear housing 32 to the toner hopper 24. The retaining clip apparatus 10 secures the toner feeder gear housing 32 to the toner hopper 24 to preferably minimize or prevent leaking of toner (not shown) out of the toner hopper 24.

Preferably, the retaining clip apparatus 10 is removable from the remanufactured toner printer cartridge 90 after securing the toner feeder gear housing 32 to the toner hopper 24. Preferably, the first end 12, the second end 14, and the elongated body portion 13 each comprises a width (w) (see FIG. 1), the widths of the first end 12, the second end 14, and the elongated body portion 13 being equal to each other. Preferably, the retaining clip apparatus 10 is unitary in shape and is comprised of spring steel, aluminum, a stiff resilient plastic, or another suitable material.

As further shown in FIG. 2, a seal 35 is provided between a bottom side 44 of the toner feeder gear housing 32 and the top of a seal platform 38 of the toner hopper 24. The seal 35 may comprise a split seal, an insertion seal, or another suitable seal. Preferably, the seal 35 is a split seal. Preferably, the seal 35 is comprised of a flexible, pliable, lightweight plastic material, a fabric ribbon material, a nylon material, or another suitable flexible, pliable, lightweight material. The seal 35 is preferably attached with a suitable adhesive (not shown) or glue over the seal platform 38 (see FIGS. 2, 8, 10) and positioned between the bottom side 44 of the toner feeder gear housing 32 and the top of the seal platform 38.

Figure 3:
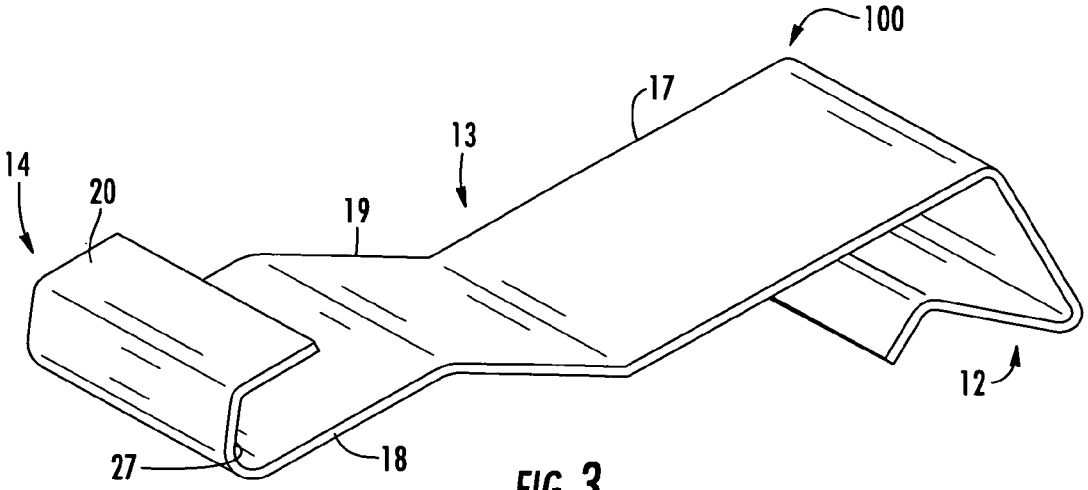
FIG. 3 is an illustration of back perspective view of another one of the embodiments of a retaining clip apparatus according to the disclosure.
Figure 4:
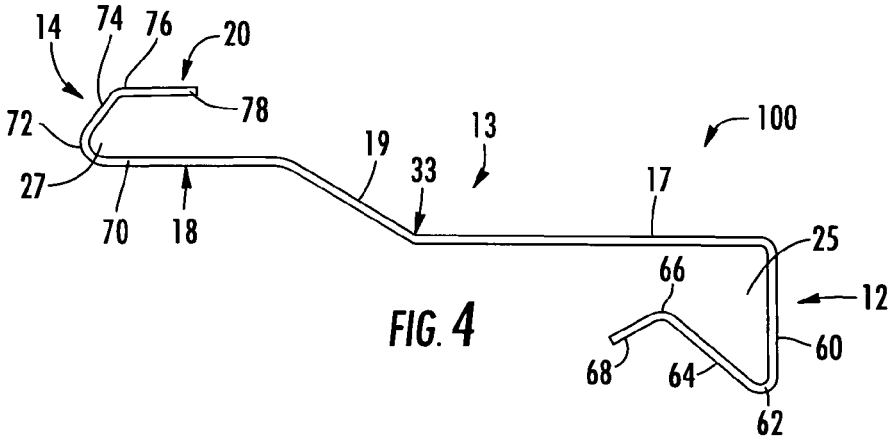
FIG. 4 is an illustration of a side view of the retaining clip apparatus of FIG. 3 according to the disclosure.
Figure 5:
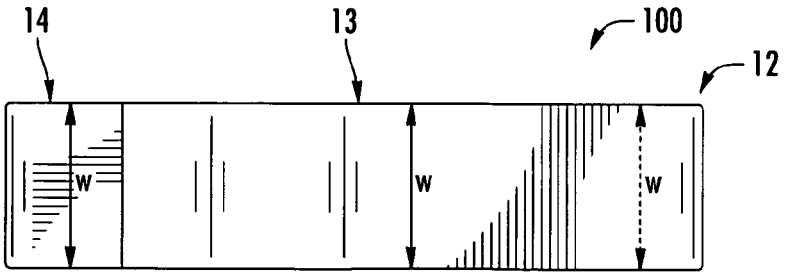
FIG. 5 is an illustration of a top view of the retaining clip apparatus of FIG. 3 according to the disclosure.

FIG. 3 is an illustration of back perspective view of another one of the embodiments of a retaining clip apparatus 100 according to the disclosure. FIG. 4 is an illustration of a side view of the retaining clip apparatus 100 of FIG. 3 according to the disclosure. FIG. 5 is an illustration of a top view of the retaining clip apparatus 100 of FIG. 3 according to the disclosure. As shown in FIGS. 3-4, the retaining clip apparatus 100 comprises a first end 12, a second end 14, and an elongated body portion 13 disposed between the first end 12 and the second end 14 and connecting the first end 12 and the second end 14. The elongated body portion 13 may comprise a substantially straight portion 17 and an angled portion 19 that angles upwardly at an angle 33, preferably a substantially 45 degree angle or another suitable angle size, from the substantially straight portion 17 toward the second end 14. The first end 12 comprises a substantially U-shaped portion 25. The first end 12 has a substantially straight first portion 60, a substantially angled or curved second portion 62, a substantially straight third portion 64, a substantially angled or curved fourth portion 66, and a substantially straight fifth end piece portion 68 (see FIG. 4).

As shown in FIG. 4, the second end 14 has a first surface 18 and a second surface 20. The second end 14 comprises a substantially U-shaped portion 27. The second end 14 has a substantially straight first portion 70, a substantially curved second portion 72, a substantially straight third portion 74, a substantially angled or curved fourth portion 76, and a substantially straight fourth end piece portion 78. Preferably, the first end 12, the second end 14, and the elongated body portion 13 each comprises a width (w) (see FIG. 5), the widths of the first end 12, the second end 14, and the elongated body portion 13 being equal to each other. Preferably, the retaining clip apparatus 100 is unitary in shape and is comprised of spring steel, aluminum, a stiff resilient plastic, or another suitable material. Preferably, the retaining clip apparatus 100 can be used with toner printer cartridge 26 (see FIG. 14), such as an HP (Hewlett-Packard) 6015 cartridge, or another suitable printer cartridge. Similar to the retaining clip apparatus 10, the retaining clip apparatus 100 is designed to engage, secure, and retain the protruding edge 28 (see FIG. 2) of the toner hopper 24 of the remanufactured printer cartridge 90, and the first end 12 can retain the protruding edge 28 (see FIG. 2) of the toner hopper 24 (see FIG. 2) to the toner feeder gear housing 32. The first surface 18 of the second end 14 can engage the portion 30 (see FIG. 2) of the toner feeder gear housing 32 (see FIG. 2), and the second surface 20 can engage the portion 34 (see FIG. 2) of the top cover housing 36 (see FIG. 2). When the top cover housing 36 is attached to the toner hopper 24, the top cover housing 36 presses against the second end 14, and the second end 14 applies a downward force (F↓) (see FIG. 2) against the portion 30 of the toner feeder gear housing 32. The retaining clip apparatus 100 is designed to secure and retain the toner feeder gear housing 32 to the toner hopper 24.

Figure 6A:
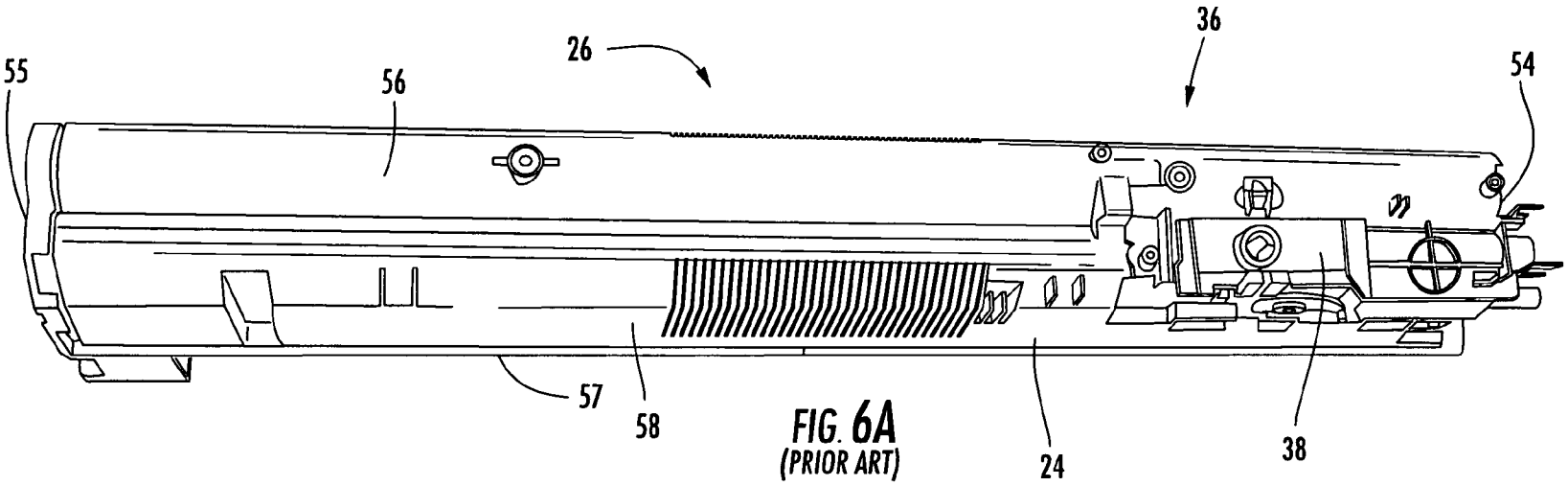
FIG. 6A (PRIOR ART)
FIG. 6A is an illustration of a bottom view of an existing toner printer cartridge showing a seal platform.
Figure 6B:
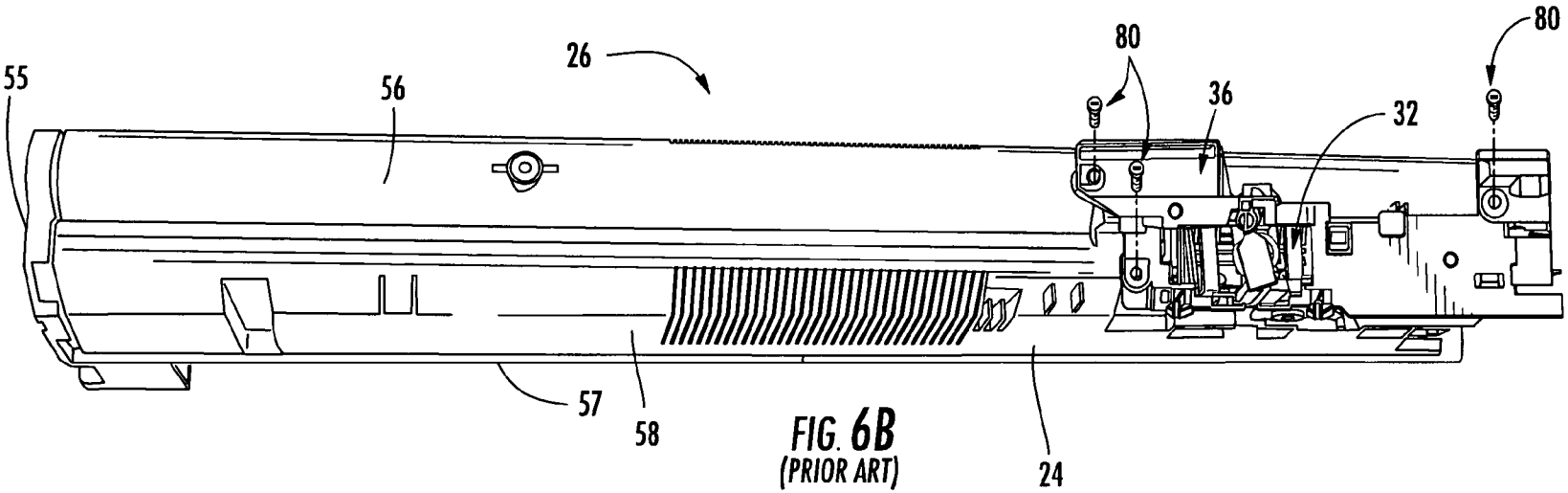
FIG. 6B (PRIOR ART)
FIG. 6B is an illustration of a bottom view of the toner printer cartridge of FIG. 6A showing a top cover housing and a toner feeder gear housing.
Figure 7A:
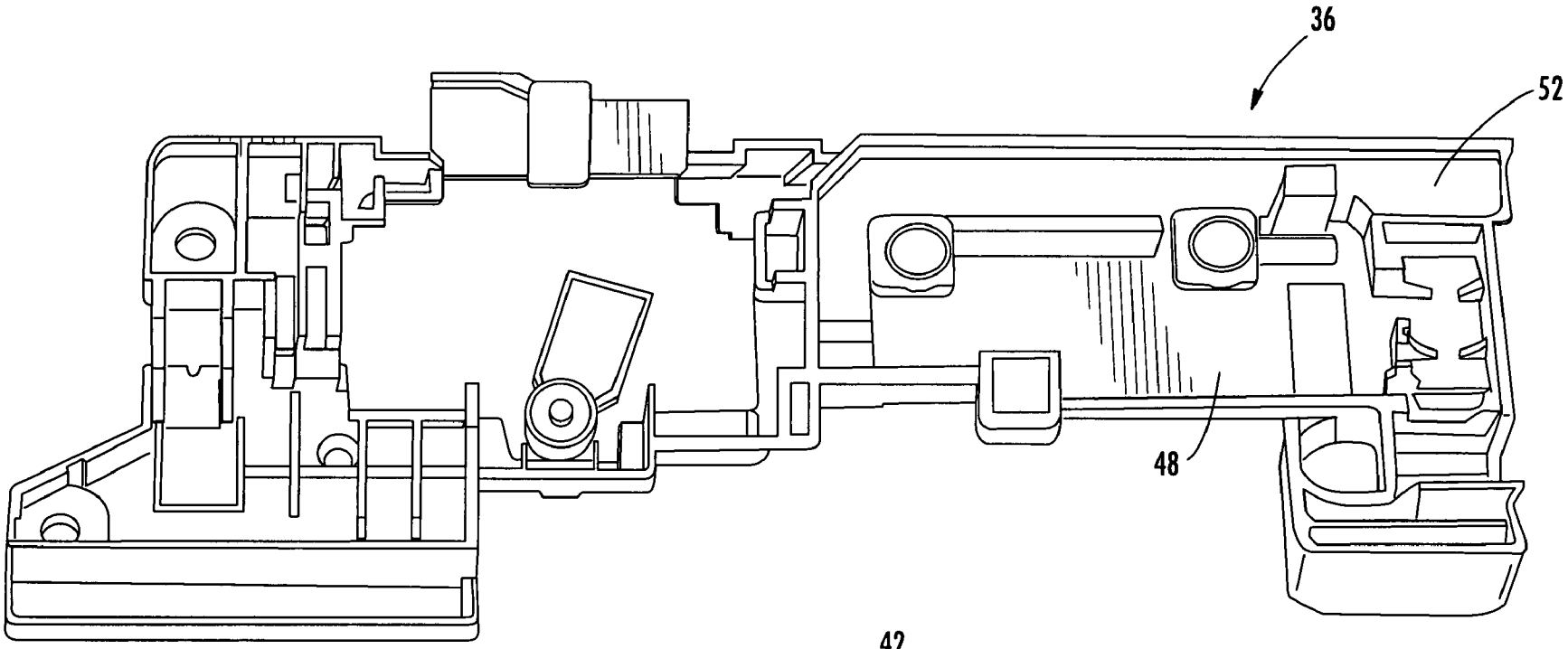
FIG. 7A (PRIOR ART)
FIG. 7A is an illustration of a bottom view of an existing top cover housing for use with the toner printer cartridge of FIGS. 6A-6B.
Figure 7C:
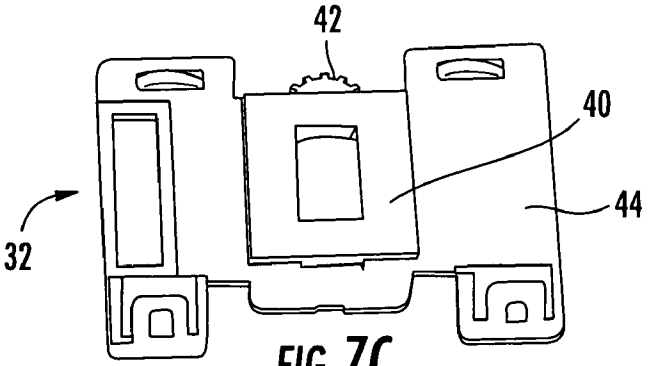
FIG. 7C (PRIOR ART)
FIG. 7C is an illustration of a bottom view of an existing toner feeder gear housing for use with the toner printer cartridge of FIGS. 6A-6B.
Figure 7B:
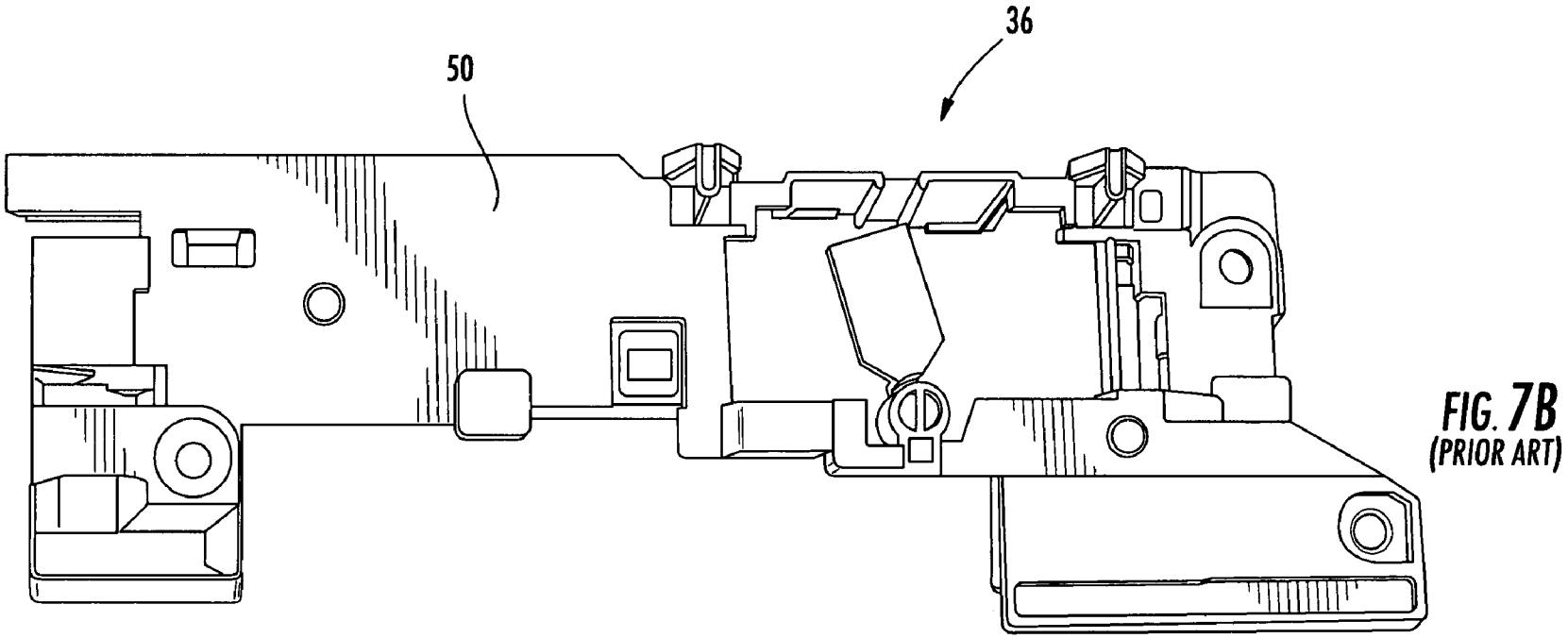
FIG. 7B (PRIOR ART)
FIG. 7B is an illustration of a top view of the existing top cover housing of FIG. 7A.
Figure 7D:
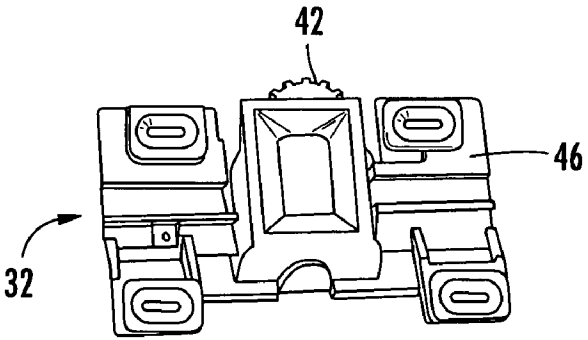
FIG. 7D (PRIOR ART)
FIG. 7D is an illustration of a top view of the existing toner feeder gear housing of FIG. 7C.

FIG. 14 is an illustration of existing toner printer cartridge 26 that may be remanufactured using one of the embodiments of the retaining clip apparatus 10 or 100 of the disclosure. FIG. 6A is an illustration of a bottom view of an existing toner printer cartridge 26 showing a seal platform 38 which is the area for attaching the seal 35. FIG. 6B is an illustration of a bottom view of the toner printer cartridge 26 of FIG. 6A showing a top cover housing 36 and a toner feeder gear housing 32. As shown in FIG. 6A, the toner printer cartridge 26 comprises a first end 54, a second end 55, a bottom side 56, a top side 57 (see also FIG. 14), a front side 58, and a back side 59 (see also FIG. 14). FIG. 7A is an illustration of a bottom view of the top cover housing 36 for the toner hopper 24 for the toner printer cartridge 26 (see FIG. 6B). FIG. 7B is an illustration of a top view of the top cover housing 36 of FIG. 7A. The top cover housing 36 has a bottom side 48 (see FIG. 7A) and a top side 50 (see FIG. 7B). Further, the top cover housing 36 has a toner sensor 52 (see FIG. 7A). The toner sensor 52 is used to indicate the toner level in the toner hopper 24. FIG. 7C is an illustration of a bottom view of a toner feeder gear housing 32 for the toner hopper 24 (see FIG. 6B). FIG. 7D is an illustration of a top view of the toner feeder gear housing 32 of FIG. 7C. As shown in FIG. 7C, the toner feeder gear housing 32 comprises a foam sealing portion or gasket 40, a feeder gear 42, and a bottom side 44. As shown in FIG. 7D, the toner feeder gear housing 32 further comprises a top side 46.

Figure 8:
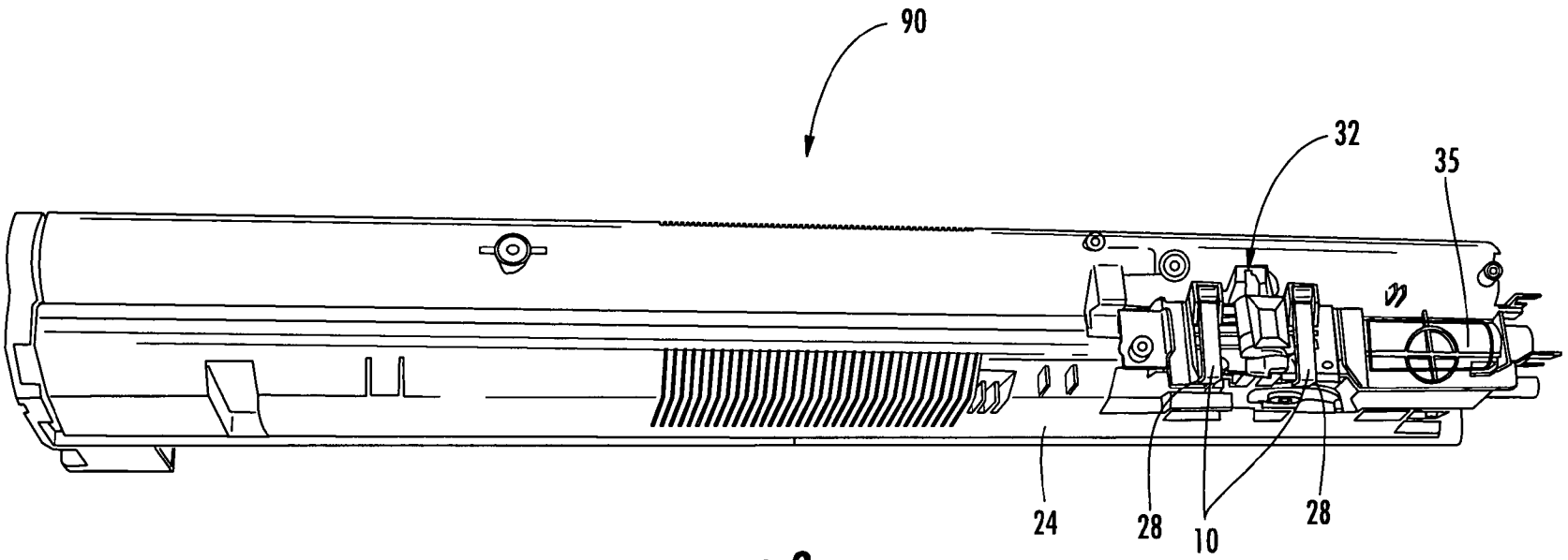
FIG. 8 is an illustration of a bottom view of a remanufactured toner printer cartridge with one of the embodiments of the retaining clip apparatus attached.
Figure 9:
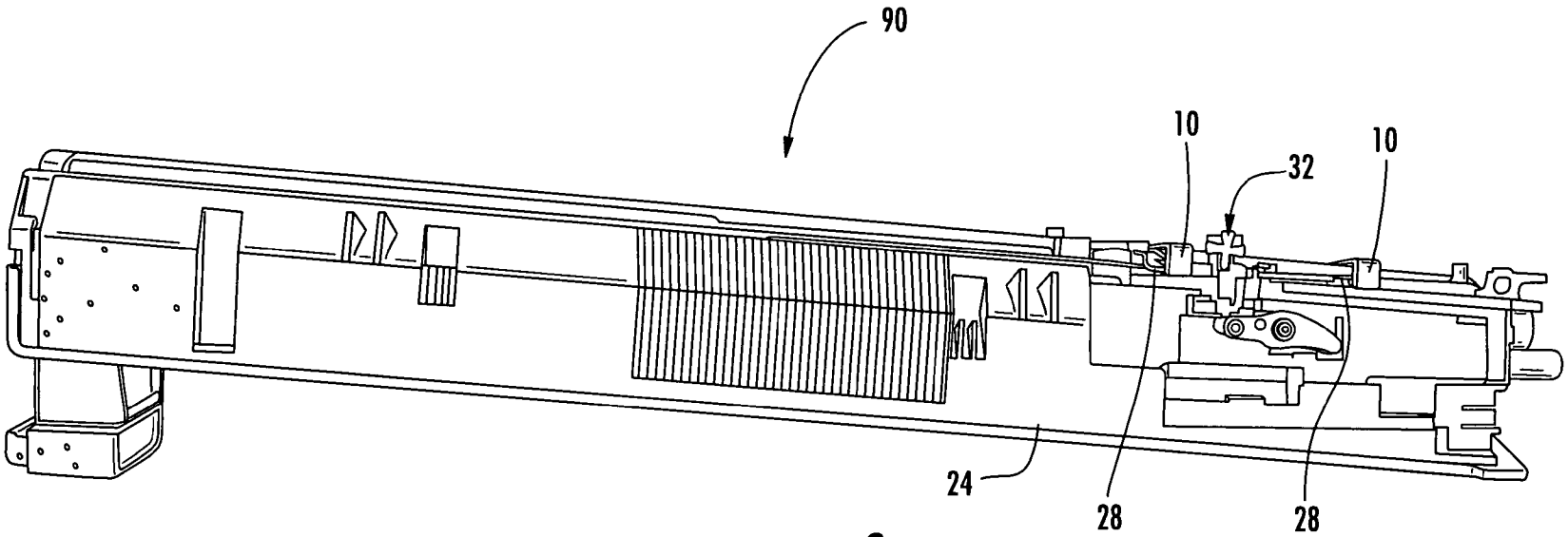
FIG. 9 is an illustration of a left side view of the remanufactured toner printer cartridge of FIG. 8 with one of the embodiments of the retaining clip apparatus attached.
Figure 10:
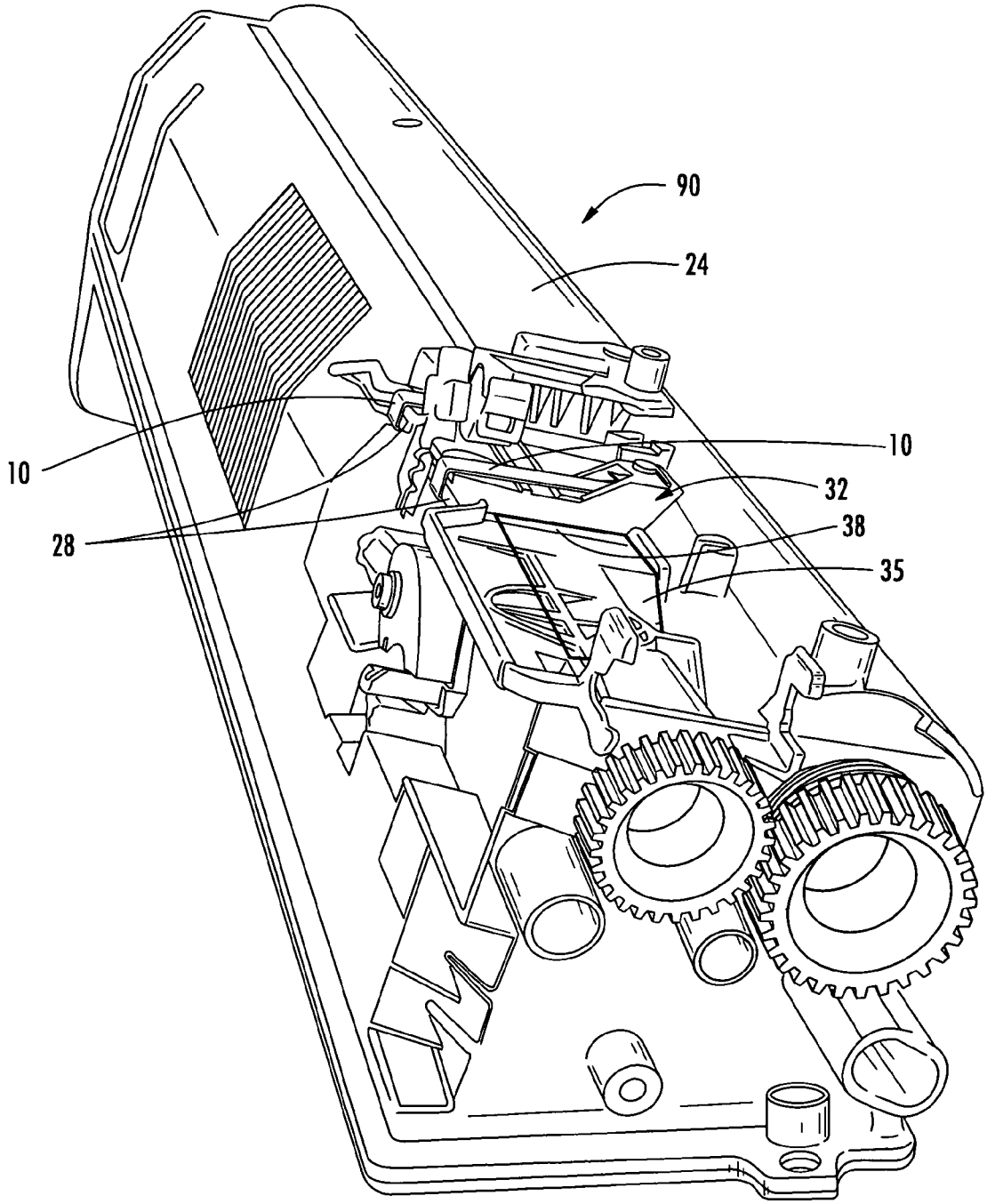
FIG. 10 is an illustration of a front perspective view of the remanufactured toner printer cartridge of FIG. 8 with one of the embodiments of the retaining clip apparatus attached.
Figure 11:
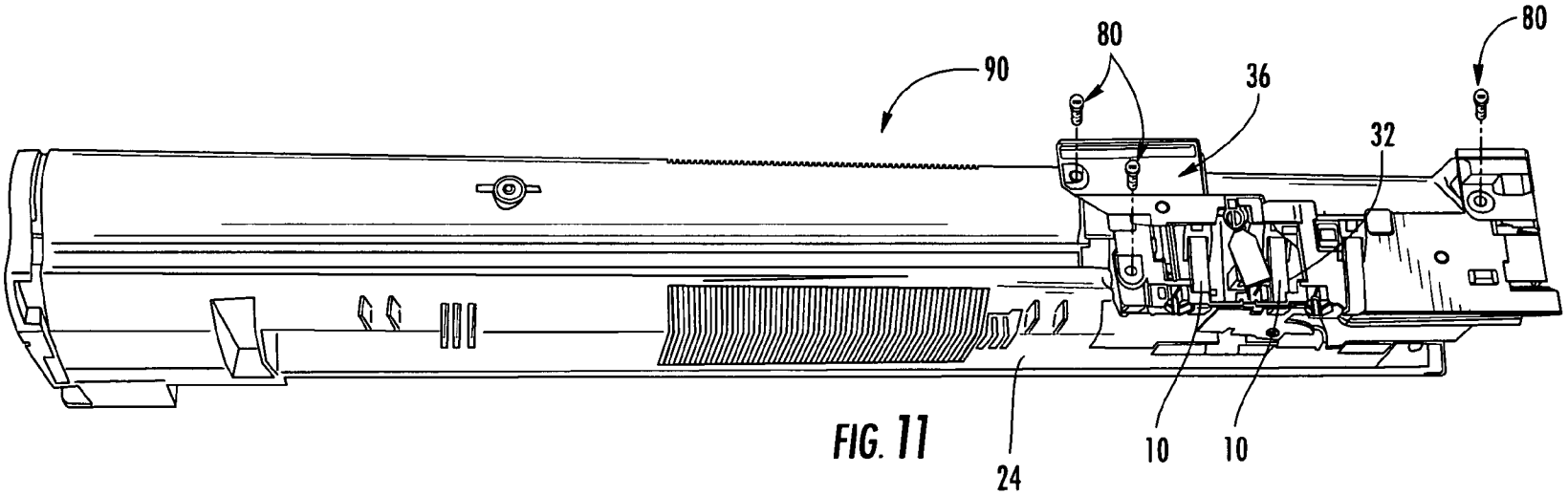
FIG. 11 is an illustration of a bottom view of the remanufactured toner printer cartridge of FIG. 8 with the top cover housing attached over the toner feeder gear housing.
Figure 12:
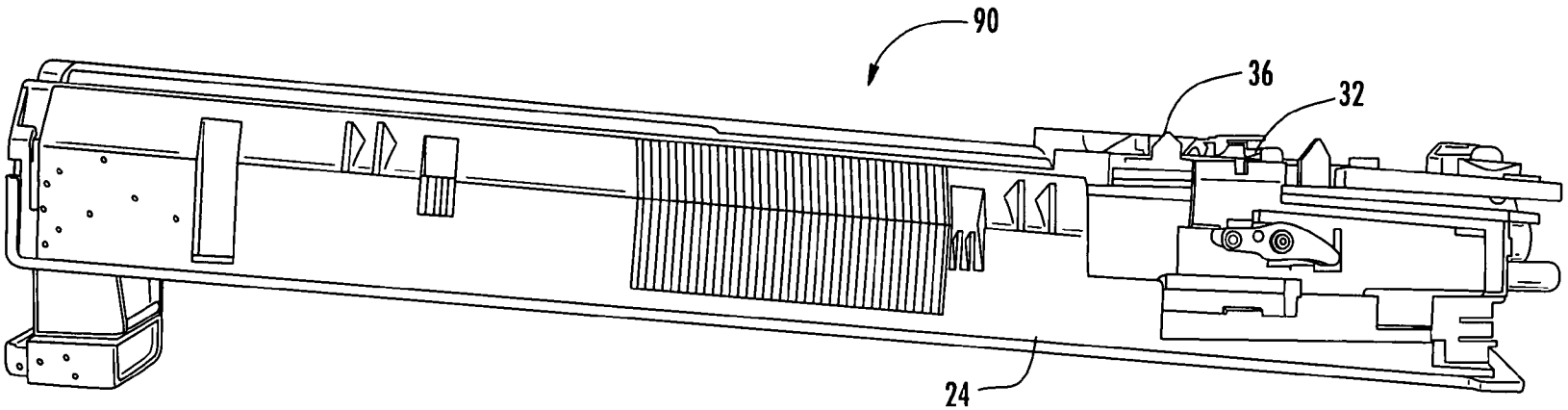
FIG. 12 is an illustration of a left side view of the remanufactured toner printer cartridge of FIG. 8 with the top cover housing attached over the toner feeder gear housing.

FIG. 8 is an illustration of a bottom view of remanufactured toner printer cartridge 90 with one of the embodiments of the retaining clip apparatus 10 attached. Retaining clip apparatus 100 may also be used with remanufactured toner printer cartridge 90. FIG. 8 shows the use of two (2) retaining clip apparatuses 10 attached to the protruding edge 28 of the toner hopper 24 to secure the toner feeder gear housing 32 to the toner hopper 24. FIG. 9 is an illustration of a left side view of the remanufactured toner printer cartridge 90 of FIG. 8 with one of the embodiments of the retaining clip apparatus 10 attached. FIG. 9 shows the use of two (2) retaining clip apparatuses 10 attached to the protruding edge 28 of the toner hopper 24 to secure the toner feeder gear housing 32 to the toner hopper 24. FIG. 10 is an illustration of a front perspective view of the remanufactured toner printer cartridge 90 of FIG. 8 with one of the embodiments of the retaining clip apparatus 10 attached. FIG. 10 shows the use of two (2) retaining clip apparatuses 10 attached to the protruding edge 28 of the toner hopper 24 to secure the toner feeder gear housing 32 to the toner hopper 24. FIG. 10 also shows sealing platform 38 where seal 35 is attached. FIG. 11 is an illustration of a bottom view of the remanufactured toner printer cartridge 90 of FIG. 8 with the top cover housing 36 attached over the toner feeder gear housing 32. As shown in FIG. 11, the top cover housing 36 is preferably attached to the toner hopper 24 with one or more attachment elements 80, preferably in the form of screws 82, that can be inserted through one or more openings 84 in the top cover housing 36. FIG. 12 is an illustration of a left side view of the remanufactured toner printer cartridge 90 of FIG. 8 with the top cover housing 36 attached over the toner feeder gear housing 32. FIG. 13 is an illustration of a front perspective view of the remanufactured toner printer cartridge 90 of FIG. 8 with the top cover housing 36 attached over the toner feeder gear housing 32. Although the remanufactured toner printer cartridge 90 of FIGS. 8-10 is preferably shown with two (2) retaining clip apparatuses 10, one (1) retaining clip apparatus may also be used or more than two (2) retaining clip apparatuses may also be used.

In another embodiment of the disclosure there is provided a remanufactured toner printer cartridge 90 (see FIGS. 8-13) using one of the embodiments of the retaining clip apparatus 10 or 100. The remanufactured toner printer cartridge 90 comprises toner hopper 24, toner feeder gear housing 32, top cover housing 36, seal 35, and one or more retaining clip apparatuses 10 or 100 for securing the toner feeder gear housing 32 to the toner hopper 24. The retaining clip apparatus 10 or 100 comprises a first end 12 that retains a protruding edge 28 of the toner hopper 24 and a second end 14 having a first surface 18 that engages a portion 30 of the toner feeder gear housing 32 and having a second surface 20 that engages a portion 34 of the top cover housing 36. When the top cover housing 36 is attached to the toner hopper 24, the top cover housing 36 presses against the second end 14, and the second end 14 applies a downward force (F↓) (see FIG. 2) against the portion 30 of the toner feeder gear housing 32. The retaining clip apparatus 10 or 100 is designed to secure and retain the toner feeder gear housing 32 to the toner hopper 24. Preferably, the first end 12 of the retaining clip apparatus 10 or 100 comprises a substantially U-shaped portion 25. Preferably, the second end 14 of the retaining clip apparatus 10 or 100 comprises a substantially U-shaped portion 27. Preferably, the retaining clip apparatus 10 or 100 is unitary in shape and is comprised of a material selected from the group consisting of spring steel, aluminum, and resilient plastic. Preferably, the remanufactured toner printer cartridge 90 comprises two (2) retaining clip apparatuses 10 or 100. Preferably, the first end 12, the second end 14, and the elongated body portion 13 each comprises a width (w) (see FIGS. 1 and 5), the widths of the first end 12, the second end 14, and the elongated body portion 13 being equal to each other. Preferably, the retaining clip apparatus 10 or 100 is removable from the remanufactured toner printer cartridge 90 after securing the toner feeder gear housing 32 to the toner hopper 24 in order to perform a subsequent cycle of remanufacturing of the remanufactured toner printer cartridge 90, if desired.

Figure 15:
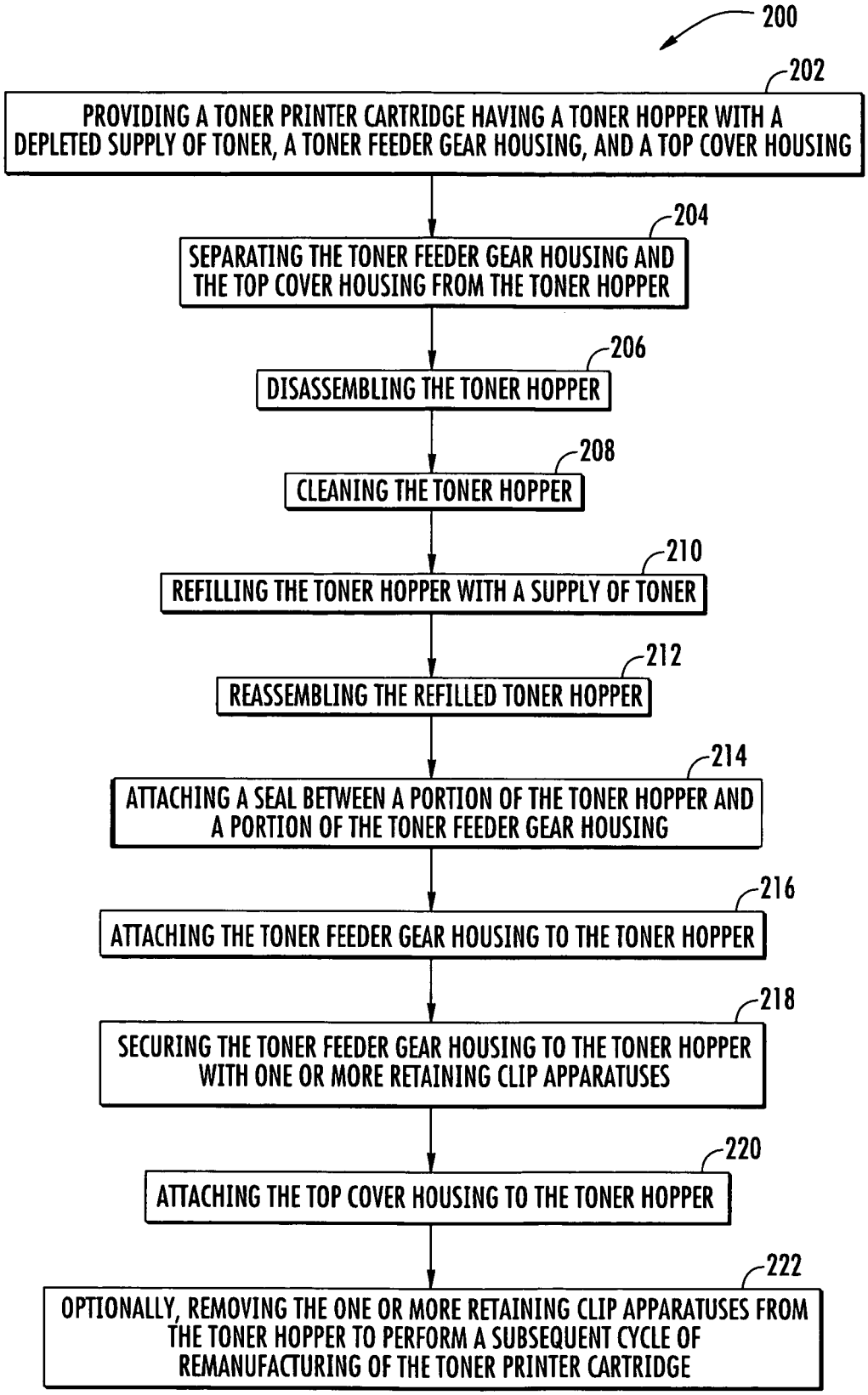

In another embodiment of the disclosure there is provided a method 200 for remanufacturing a toner printer cartridge 26. FIG. 15 is an illustration of a flow diagram showing the steps of one of the embodiments of the method 200 for remanufacturing a toner printer cartridge 26 (see FIG. 14) of the disclosure. The method 200 comprises step 202 of providing a toner printer cartridge 26 having a toner hopper 24 with a depleted supply of toner (not shown), a toner feeder gear housing 32, and a top cover housing 36. The method 200 further comprises step 204 of separating the toner feeder gear housing 32 and the top cover housing 36 from the toner hopper 24 (see FIGS. 7A, 7C). The method 200 further comprises step 206 of disassembling the toner hopper 24. The method 200 further comprises step 208 of cleaning the toner hopper 24. The method 200 further comprises step 210 of refilling the toner hopper 24 with a supply of toner (not shown). The method 200 further comprises step 212 of reassembling the toner hopper 24 that has been refilled. The method 200 further comprises step 214 of attaching a seal 35 (see FIG. 2) between a portion of the toner hopper 24 that has been refilled, preferably the top of the seal platform 38, and a portion of the toner feeder gear housing 32, preferably the bottom side 44 of the toner feeder gear housing 32. The method 200 further comprises step 216 of attaching the toner feeder gear housing 32 to the toner hopper 24 that has been refilled. The method 200 further comprises step 218 of securing the toner feeder gear housing 32 to the toner hopper 24 that has been refilled with one or more retaining clip apparatuses 10 or 100.

As discussed above, the retaining clip apparatus 10 or 100 comprises a first end 12, a second end 14, and an elongated body portion 13 disposed between the first end 12 and the second end 14 and connecting the first end 12 and the second end 14. The first end 12 is configured to engage a protruding edge 28 of the toner hopper 24. The second end 14 has a first surface 18 configured to engage a portion 30 of the toner feeder gear housing 32 and the second end 14 has a second surface 20 configured to engage a portion 34 of the top cover housing 36, such that the second end 14 is positioned within a space 29 between the top cover housing 36 and the toner feeder gear housing 32. When the top cover housing 36 is attached to the toner hopper 24, the top cover housing 36 presses against the second end 14, and the second end 14 applies a downward force (F↓) (see FIG. 2) against the portion 30 of the toner feeder gear housing 32. The retaining clip apparatus 10 is designed to secure and retain the toner feeder gear housing 32 to the toner hopper 24. The elongated body portion 13 has one or more abutting surfaces 15*a*, 15*b* configured to abut one or more portions 23*a*, 23*b* of the toner feeder gear housing 32.

Preferably, the retaining clip apparatus 10 or 100 is removable from the remanufactured toner printer cartridge 90 after securing the toner feeder gear housing 32 to the toner hopper 24. Preferably, the retaining clip apparatus 10 or 100 is unitary in shape and is comprised of spring steel, aluminum, a stiff resilient plastic, or another suitable material.

The method 200 further comprises step 220 of attaching the top cover housing 36 to the toner hopper 24 that has been refilled to form a remanufactured toner printer cartridge 90 (see FIGS. 2, 11). Preferably, the top cover housing 36 is attached with attachment elements 80 in the form of one or more screws 82 (see FIG. 11) that may be inserted into one or more corresponding openings 84 in the top cover housing 36. The method 200 may further comprise optional step 222 of removing the one or more retaining clip apparatuses 10 or 100 from the toner hopper 24 to perform a subsequent cycle of remanufacturing of the remanufactured toner printer cartridge 90. Preferably, two (2) retaining clip apparatuses 10 or 100 are used to retain the toner feeder gear housing 32 to the toner hopper 24 that has been refilled. However, one (1) retaining clip apparatus may also be used or more than two (2) retaining clip apparatuses may also be used.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation. The disclosure is not limited in its application to the details of the construction and to the arrangement of the components set forth in the above description or as illustrated in the drawings.

What is claimed is:

1. A retaining clip apparatus for securing a toner hopper of a toner printer cartridge, the toner hopper having a toner feeder gear housing and a top cover housing, the apparatus comprising:

a first end configured to engage a protruding edge of the toner hopper;

a second end having a first surface configured to engage a portion of the toner feeder gear housing and having a second surface configured to engage a portion of the top cover housing, wherein the second end comprises a substantially U-shaped portion, the substantially U-shaped portion being substantially positioned and fitted within a space between the top cover housing and the toner feeder gear housing, wherein when the top cover housing is attached to the toner hopper, the top cover housing presses against the second end, and the second end applies a downward force against the portion of the toner feeder gear housing; and, an elongated body portion connecting the first end to the second end, the first end and the second end extending from the elongated body portion in opposite directions, the elongated body portion having one or more abutting surfaces configured to abut one or more portions of the toner feeder gear housing, wherein the retaining clip apparatus secures the toner feeder gear housing to the toner hopper.

2. The apparatus of claim 1 wherein the apparatus is unitary in shape.

3. The apparatus of claim 1 wherein the apparatus is comprised of a material selected from the group consisting of spring steel, aluminum, and resilient plastic.

4. The apparatus of claim 1, wherein the first end comprises a substantially U-shaped portion.

5. The apparatus of claim 1, wherein the toner printer cartridge is a remanufactured toner printer cartridge.

6. The apparatus of claim 1, wherein the first end, the second end, and the body portion each comprises a width, the widths of the first end, the second end, and the body portion being equal to each other.

7. The apparatus of claim 1, wherein the apparatus is removable from the toner printer cartridge after securing the toner feeder gear housing to the toner hopper.

8. The apparatus of claim 1, wherein the apparatus secures the toner feeder gear housing to the toner hopper to minimize or prevent leaking of toner out of the toner hopper.

9. A remanufactured toner printer cartridge comprising a toner hopper, a toner feeder gear housing, a top cover housing, a seal, and one or more retaining clip apparatuses for securing the toner feeder gear housing to the toner hopper, wherein the retaining clip apparatus comprises:

a first end configured to engage a protruding edge of the toner hopper;

a second end having a first surface configured to engage a portion of the toner feeder gear housing and having a second surface configured to engage a portion of the top cover housing, wherein the second end comprises a substantially U-shaped portion, the substantially U-shaped portion being substantially positioned and fitted within a space between the top cover housing and the toner feeder gear housing, wherein when the top cover housing is attached to the toner hopper, the top cover housing presses against the second end, and the second end applies a downward force against the portion of the toner feeder gear housing; and, an elongated body portion connecting the first end to the second end, the first end and the second end extending from the elongated body portion in opposite directions, the elongated body portion having one or more abutting surfaces configured to abut one or more portions of the toner feeder gear housing, wherein the retaining clip apparatus secures the toner feeder gear housing to the toner hopper.

10. The cartridge of claim 9 comprising two retaining clip apparatuses.

11. The cartridge of claim 9 wherein the retaining clip apparatus is unitary in shape.

12. The cartridge of claim 9 wherein the retaining clip apparatus is comprised of a material selected from the group consisting of spring steel, aluminum, and resilient plastic.

13. The cartridge of claim 9, wherein the first end comprises a substantially U-shaped portion.

14. The cartridge of claim 9, wherein the first end, the second end, and the body portion each comprises a width, the widths of the first end, the second end, and the body portion being equal to each other.

15. The cartridge of claim 9, wherein the retaining clip apparatus is removable from the remanufactured toner printer cartridge after securing the toner feeder gear housing to the toner hopper in order to perform a subsequent cycle of remanufacturing of the remanufactured toner printer cartridge.

16. A method for remanufacturing a toner printer cartridge comprising:

providing a toner printer cartridge having a toner hopper with a depleted supply of toner, a toner feeder gear housing, and a top cover housing;

separating the toner feeder gear housing and the top cover housing from the toner hopper;

disassembling the toner hopper;

cleaning the toner hopper;

refilling the toner hopper with a supply of toner;

reassembling the toner hopper that has been refilled;

attaching a seal between a portion of the toner hopper that has been refilled and a portion of the toner feeder gear housing;

attaching the toner feeder gear housing to the toner hopper that has been refilled;

securing with one or more retaining clip apparatuses the toner feeder gear housing to the toner hopper that has been refilled, the retaining clip apparatus comprising:

a first end configured to engage a protruding edge of the toner hopper;

a second end having a first surface configured to engage a portion of the toner feeder gear housing and having a second surface configured to engage a portion of the top cover housing, wherein the second end comprises a substantially U-shaped portion, the substantially U-shaped portion being substantially positioned and fitted within a space between the top cover housing and the toner feeder gear housing; and, an elongated body portion connecting the first end to the second end, the first end and the second end extending from the elongated body portion in opposite directions, the elongated body portion having one or more abutting surfaces configured to abut one or more portions of the toner feeder gear housing; and, attaching the top cover housing to the toner hopper that has been refilled to form a remanufactured toner printer cartridge.

17. The method of claim 16, further comprising after attaching the top cover housing to the toner hopper that has been refilled, removing the one or more retaining clip apparatuses from the toner hopper to perform a subsequent cycle of remanufacturing of the remanufactured toner printer cartridge.

18. The method of claim 16, wherein two retaining clip apparatuses are used to retain the toner feeder gear housing to the toner hopper that has been refilled.

19. The method of claim 16, wherein the retaining clip apparatus is unitary in shape.

20. The method of claim 16, wherein the retaining clip apparatus is comprised of a material selected from the group consisting of spring steel, aluminum, and resilient plastic.

* * * * *